United States Patent [19]

Judge

[11] 4,173,102

[45] Nov. 6, 1979

[54] BUILDING CONSTRUCTION

[76] Inventor: Bernard Judge, 833 N. Kings Rd., Los Angeles, Calif. 90069

[21] Appl. No.: 811,131

[22] Filed: Jun. 28, 1977

[51] Int. Cl.[2] ..... E04B 1/34

[52] U.S. Cl. ..... 52/73; 52/79.4; 52/648

[58] Field of Search ..... 52/79.4, 79.11, 236.1, 52/82, 73, DIG. 10, 648, 655, 643, 648, 83, 90, 146, 148, 116; 182/82, 187

[56] References Cited

U.S. PATENT DOCUMENTS

| | | | |
|---|---|---|---|
| 2,780,484 | 2/1957 | Frye | 52/655 |
| 3,110,368 | 11/1963 | Ross | 52/225 |
| 3,724,222 | 4/1973 | Crain | 52/654 |
| 3,791,080 | 2/1974 | Stoberg | 52/82 |
| 3,913,285 | 10/1975 | Helfrich | 52/79.4 |

FOREIGN PATENT DOCUMENTS

| | | | |
|---|---|---|---|
| 150932 | 5/1937 | Austria | 52/655 |
| 593200 | 10/1947 | United Kingdom | 52/82 |

OTHER PUBLICATIONS

Architectural Record, May 1972, pp. 86 & 87.
Copy Design Lib., vol. 151, May 1972.

*Primary Examiner*—John E. Murtagh
*Attorney, Agent, or Firm*—William W. Glenny

[57] ABSTRACT

A building structure supported by four central vertical columns fixed to the ground at vertices of a rectangle whose dimensions are much smaller than the dimensions of a floor of the eventual building. Segments of the columns constitute spreaders in upper and lower sets of trusses, each set including two pairs of trusses, the trusses of one pair being parallel to one another and perpendicular to the trusses of the other pair, and the upper and lower sets being vertically aligned. The chords of each truss extend outwardly from the columns, and the outer ends of the chords of the upper trusses are connected to the outer ends of corresponding chords of the lower trusses by generally vertical structural members by which to support, in cooperation with the columns, one or more floors of the structure above the bottom floor. Each column is the principal longitudinal member of a module havihg a rectangular transverse section throughout the major portion of its length and including members fixed to the column and projecting therefrom which, after erection, become segments of the chords of the trusses. Each module, when its column is horizontal, has lateral and vertical dimensions no greater than about 12 feet, or 3.5 meters, so that the modules can be safely and conveniently transported on a road or highway from a fabrication factory or the like to the site of the building, thereby minimizing expensive on-site work. The small size of the rectangle formed by the four columns permits inexpensive erection of the building even on steep slopes.

5 Claims, 7 Drawing Figures

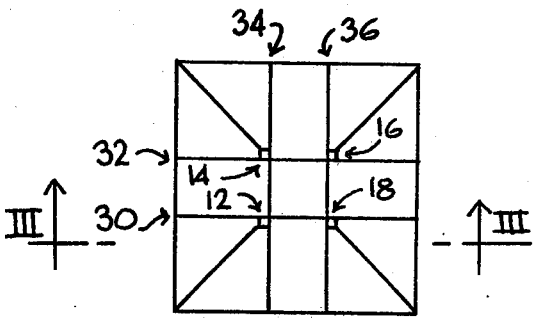
FIG. 2
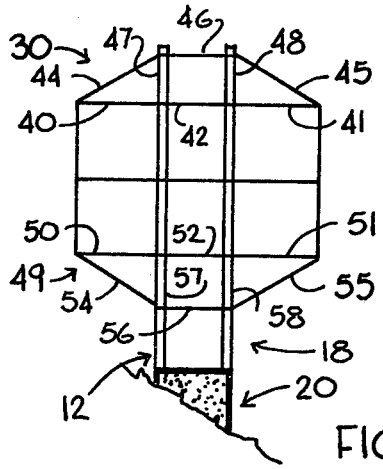
FIG. 3
FIG. 1
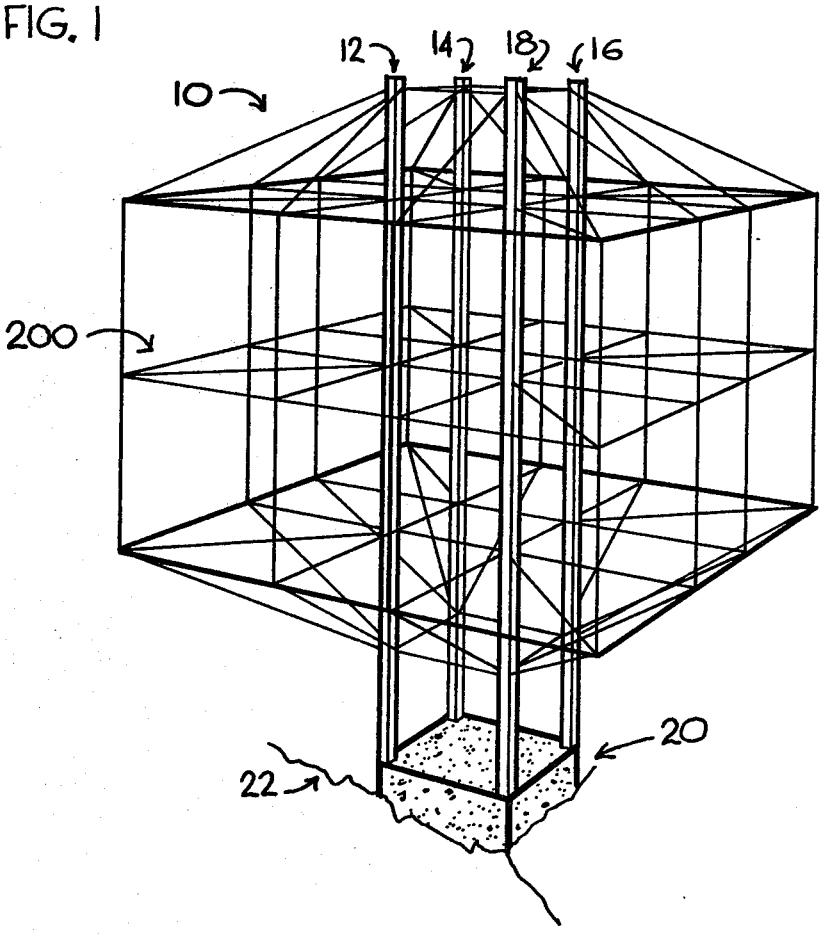

FIG. 6
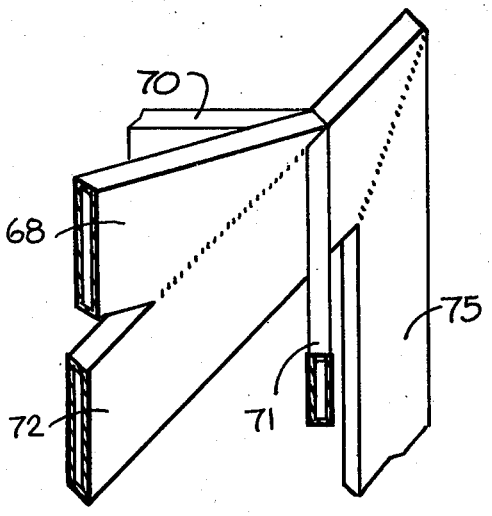
FIG. 7
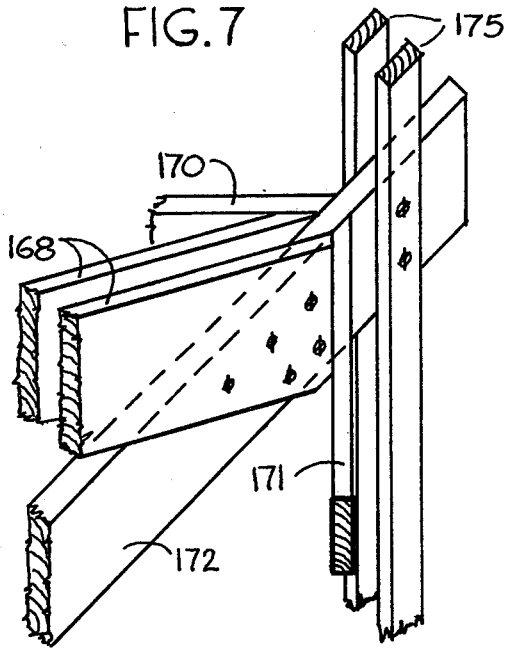
FIG. 4
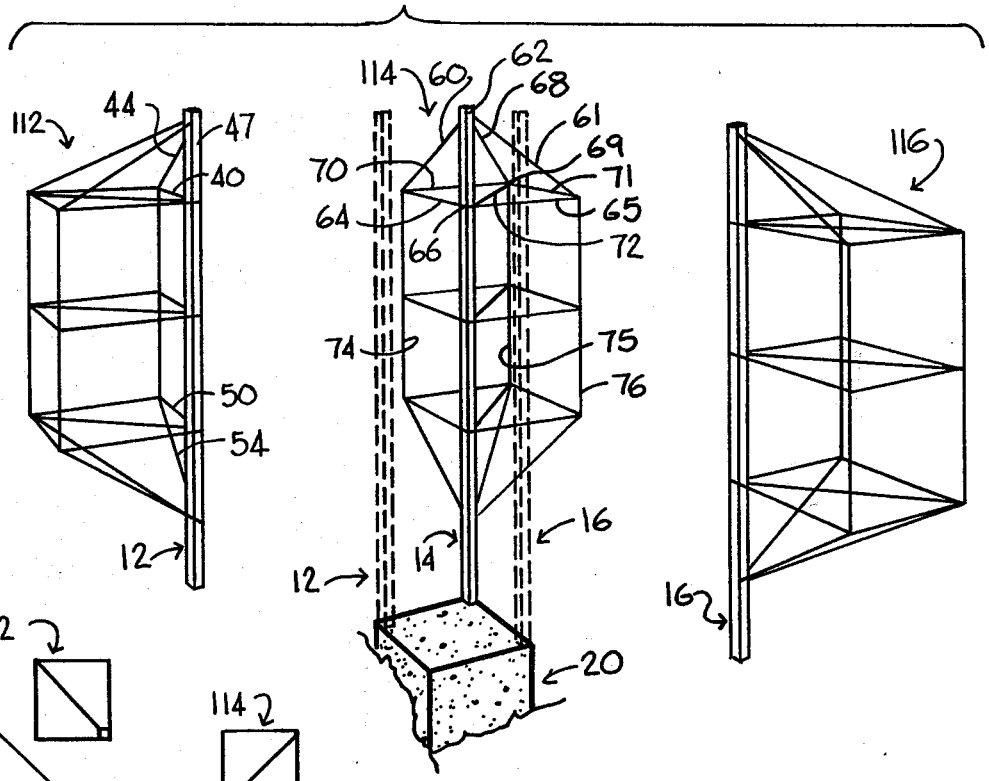
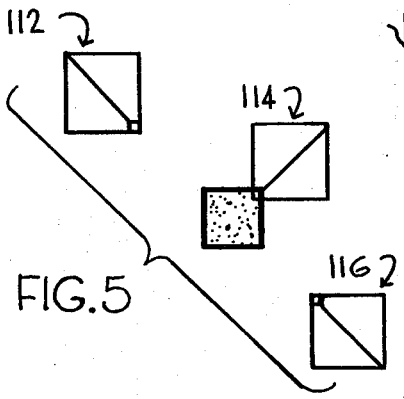
FIG. 5

BUILDING CONSTRUCTION

BACKGROUND AND SUMMARY OF THE INVENTION

The present invention relates generally to construction of buildings, and more particularly describes a novel building construction for homes or similar structures having a floor plan in which neither the length nor width exceeds, say, about 30 feet or about 9 meters. The invention is especially advantageous in building on land which is steeply sloping.

Building homes on steeply sloping land typically involves expensive site preparation such as earth-moving and the erection of structural support members of substantial length and complexity. As a result, much land area in hilly terrain has come to be regarded as "unbuildable" for homes because of the costs involved. Furthermore, it is well known that structural components of a building can be fabricated much less expensively indoors, as at a factory, than at the building site itself. Hence prefabricated components are economically advantageous provided that they can be safely and conveniently transported on conventional roads from the place of manufacture to the site. This latter factor requires that neither the width nor the height of the components may exceed some maximum value permitted by the authorities, typically about 12 feet, or about 3.5 meters.

In accordance with the present invention there are provided four modules which may be economically fabricated indoors and then transported to the site for erection. Each module includes a column which will be vertical when erected, and additional structural members fixed to the column which form portions of structural trusses in the completed building. When the module is transported with its column horizontal, neither its width nor its height exceeds a value typically permitted on highways, such as about 12 feet, but the finished building can provide a floor plan of 30 feet or even more in length and width. The illustrative embodiment of the invention herein described and shown has two stories, as for a typical home, but any reasonable number of stories can be provided.

In the finished structure in accordance with the invention, the vertical columns of the four modules are fixed to the ground by suitable means, herein shown as including a concrete foundation. The axes of the columns lie at vertices of a rectangle, herein shown as a square, having a length and width of 10 feet or less, so that the concrete foundation can be economically poured even on a steep slope.

With the columns erected and joined by horizontal connectors at points spaced along their lengths, there are created upper and lower sets of trusses, with segments of the columns serving as spreaders in the trusses. Each set of trusses includes two pairs of parallel trusses perpendicular to the trusses of the other pair, and the trusses of the upper set are vertically aligned with corresponding trusses of the lower set. Structural members such as struts extend generally vertically between corresponding points on upper and lower trusses spaced outwardly from the columns, and struts also extend generally vertically between the outer ends of inclined hip members extending angularly from each column at the top of the upper trusses and at the bottom of the lower trusses. The modules and other structural members can be made of wood or steel, or other material of comparable strength.

It is accordingly a principal object of the present invention to provide a novel building construction especially advantageous for use on steeply sloping land. Other objects are to disclose four prefabricated modules for use in such construction having lateral dimensions permitting convenient transportation on conventional roads; to provide such modules each having an elongated column and structural members fixed thereto which become chord segments of structural trusses in the completed building; to provide, in such a construction, upper and lower sets of trusses, each set including two pair of trusses parallel to one another and perpendicular to the trusses of the other pair; to provide such trusses including spreaders which are segments of the module columns; and for additional purposes which will be understood from the following description of a preferred embodiment of the invention taken in connection with the accompanying drawings.

BRIEF DESCRIPTION OF THE DRAWINGS

FIG. 1 is a perspective view of a building structure embodying the present invention.

FIG. 2 is a top plan view of the structure.

FIG. 3 is a side elevational view taken on the arrows III—III of FIG. 2.

FIG. 4 is a perspective view showing one of the four modules of the structure in its erected position; the two adjacent modules are shown in exploded relation in solid lines, and are partially shown in erected position in dotted outline.

FIG. 5 is a diagrammatic top plan view of the modules shown in FIG. 4.

FIG. 6 is a fragmentary isometric view of a typical connection of the members at one end of one of the trusses, as the parts appear when they are made of a weldable material such as steel.

FIG. 7 is a view similar to FIG. 6, when the component parts are made of wood or similar nailable material.

DETAILED DESCRIPTION

Referring in detail to the drawings, a building embodying the present invention is indicated generally at 10 in FIG. 1, and includes in its central portion a set of four vertical support columns indicated generally at 12, 14, 16 and 18. The axes of the columns lie at vertices of a rectangle, which may be a square, and the columns are fixed to the ground by suitable means, here shown as including a foundation indicated generally at 20, illustratively of concrete, partially embedded in the earth 22. The building is illustratively shown as a two-story structure. The ceiling of the second story includes as structural members the lower horizontal chords of an upper set of trusses, and the floor of the first story includes as structural members the upper horizontal chords of a lower set of inverted trusses. Each truss set includes two pairs of spaced parallel trusses, the trusses of one pair being perpendicular to those of the other pair.

The construction will be further understood by reference to FIGS. 2 and 3. Thus in FIG. 2 the upper set of trusses includes a pair of parallel trusses indicated generally at 30 and 32 and, perpendicular thereto, the second pair 34 and 36 of the upper set. Each truss of the upper set includes a lower horizontal chord, an upper chord, and a pair of spreaders which are segments of two adjacent columns.

More specifically, as seen in FIG. 3, the lower horizontal chord of truss 30 comprises left and right horizontal chord segments 40 and 41 and lower connector 42; the upper chord includes inclined chord segments 44 and 45 and upper connector 46; and the spreaders constitute segments 47 and 48 of respective columns 12 and 18.

The lower portion of the structure as seen in FIG. 3 includes a truss indicated generally at 49, inverted relative to truss 30. The horizontal chord of truss 49 includes left and right horizontal chord segments 50 and 51 and upper connector 52. Its lower chord includes inclined chord segments 54 and 55 and lower connector 56; and segments 57 and 58 of respective columns 12 and 18 constitute its spreaders. Truss 49, except for being inverted relative to truss 30, is similar to the latter and may even be identical thereto. Furthermore, truss 32 is desirably identical to truss 34, and the other two trusses of the upper set, 34 and 36, are desirably identical to one another and are similar to trusses 30 and 32, although they may differ in length from the latter. It will be seen that column segments 47 and 48, as well as the corresponding segments of columns 14 and 16, which are hidden in FIG. 3, each serves as a spreader in two trusses which are mutually perpendicular. The same considerations as those just discussed apply also to the lower set of trusses including truss 49. It is also observed, as will be further explained later, that corresponding horizontal chord segments of vertically aligned trusses (such as 30 and 49) are desirably but not necessarily equal in length, so that the struts joining their outer or distal ends are desirably vertical, i.e. parallel to the central support columns.

FIGS. 4 and 5 illustrate the modular construction by which the amount of on-site fabrication is minimized in accordance with the present invention. For clarity of description only three of the four modules are shown, and they are shown as being identical to one another in dimensions, which is a typical but not necessary characteristic of the structure. Also, the component members of the modules will be described as they appear in FIG. 4, i.e. with the columns of the modules extending vertically, although it will be readily understood that each module will typically be transported from its place of manufacture to the erection site with its column, and therefore its major dimension, horizontal or substantially so.

Thus columns 12, 14 and 16 are the principal vertical structural members of modules indicated generally at 112, 114 and 116 respectively. Module 114 is shown in its erected position, with the lower portion of its column 14 fixed to foundation 20.

In its upper portion, module 114 includes inclined chord segments 60 and 61 fixed at their inner ends to a first attachment zone 62 of column 14, and horizontal chord segments 64 and 65 fixed at their inner ends to a second attachment zone 66 of the column, spaced below first attachment zone 62. Segments 60 and 64 lie in a common vertical plane and are fixed together at their outer ends, and are components of truss 32. Correspondingly, segments 61 and 65 lie in a common vertical plane and are fixed together at their outer ends, and are components of truss 34. A hip member or strut 68 extends angularly downwardly from column 14 above the second attachment zone, as at the first attachment zone 62, and is fixed at its outer end or hip point 69 to the outer ends of horizontal structural members 70 and 71, whose inner ends are fixed to the junctures of the above mentioned chord segments of trusses 32 and 34 respectively. Chord segments 64 and 65, together with members 70 and 71, form a rectangle which may be strengthened by a diagonal reinforcing strut 72 between the column and hip point 69.

The lower portion of module 114 includes components corresponding to those just described, disposed inversely, thus providing support for three vertically extending struts 74, 75 and 76 parallel to column 14 and defining therewith a figure having a rectangular transverse section throughout its length. The inner ends of the horizontal and inclined chord segments in the lower portion of the module are fixed to column 14 at third and fourth attachment zones respectively. As will be described later, support members for additional stories may be provided between the end portions of the module, such support members in the case of a two-story building including inner support members fixed at their inner ends to a fifth attachment zone on column 14 intermediate the second and third attachment zones previously mentioned.

The other two modules shown, 112 and 116, as well as a fourth module omitted from the showing of FIGS. 4 and 5, are similar to module 114, and typically are identical thereto as shown in the present illustrative embodiment of the invention.

In the process of construction, after the first module is erected, the other three modules are sequentially erected. Corresponding points of adjacent modules are tied together by horizontal structural members such as connectors 42, 46, 52 and 56 previously described in connection with FIG. 3, thus forming the upper and lower sets of mutually perpendicular pairs of trusses in accordance with the invention.

FIGS. 6 and 7 illustrate typical modes of forming junctures as at one of the hip points when the structural members are, respectively, steel and wood. In FIG. 6 the parts are desirably joined by welding. In FIG. 7 the parts are designated by reference characters 100 greater than the corresponding components in FIG. 6, and may be joined together by nailing or bolting.

The present invention is illustrated as a building frame for a two-story structure, but additional stories may be provided as desired. With reference to FIG. 1, the supporting members for the floor of a second story are indicated generally at 200, and comprise members corresponding to those of the floor of the first story and the ceiling of the second story previously described. As will be understood, the floor load of the second story is carried by the central columns and by the upper portions of the tensioned struts extending between corresponding points of the upper and lower sets of trusses. It is to be noted that the only load bearing members are the central columns and the peripheral struts. Consequently, the structure affords great flexibility to the designer in arranging walls and the like in the interior, since such walls are not required to carry any of the structural load.

Modifications may be made from the building frame above described within the scope of the invention. For example, a set of mutually perpendicular pairs of parallel trusses characteristic of the invention may be used without a second set of such trusses. Thus, with reference to FIG. 3, elimination of all structure above truss 49 and the other three trusses of the lower truss set would provide a building frame suitable as a parking pad, patio or the like having no roof; addition of peripheral vertical structural members to support a roof would produce a single story home or similar structure. The illustrated form of the module may be modified by omitting therefrom the hip members, the strut connected between their distal ends, and the horizontal members connected to that strut. These and other modifications not substantially departing from the spirit of the invention are intended to be embraced within the scope of the following claims.

I claim:

1. A building construction comprising:

a central support structure including four rigid vertical columns lying at the vertices of a rectangle and fixed at their lower ends to the ground;

a set of trusses including two mutually perpendicular pairs of parallel trusses, each truss including:

a horizontal chord;

a second chord fixed at its ends to the ends of the horizontal chord and being elsewhere vertically spaced therefrom, said chords being fixed intermediate their ends to two adjacent columns at vertically spaced attachment zones, whereby each column segment between the attachment zones serves as a spreader for mutually perpendicular truses;

a horizontally disposed connector extending between and fixed to adjacent ends of each pair of parallel trusses;

horizontally disposed elongated structural members projecting in opposite prolongation of each connector, each joined at its outer end with the outer end of another such member at a hip point;

and a hip strut extending from each hip point to the adjacent column at an attachment zone spaced from the attachment zone of the horizontal chord.

2. The invention as defined in claim 1 including a second set of trusses inverted relative to the first set, spaced vertically therefrom and in vertical alignment therewith, and otherwise corresponding in structure to the first set, and fixed to the columns at attachment zones vertically spaced from the attachment zones of the first set.

3. The invention as defined in claim 2 including struts extending generally vertically between outer ends of corresponding trusses.

4. A building construction comprising:

a central support structure including four rigid vertical columns lying at the vertices of a rectangle and fixed at their lower ends to the ground;

a first set of trusses including two mutually perpendicular pairs of parallel trusses, each truss including:

a horizontal chord;

a second chord fixed at its ends to the ends of the horizontal chord and being elsewhere vertically spaced therefrom, said chords being fixed intermediate their ends to two adjacent columns at vertically spaced attachment zones, whereby each column segment between the attachment zones serves as a spreader for mutually perpendicular trusses; and a second set of trusses inverted relative to the first set, spaced vertically therefrom and in vertical alignment therewith, and otherwise corresponding in structure to the first set, and fixed to the columns at attachment zones vertically spaced from the attachment zones of the first set.

5. The invention as defined in claim 4 including struts extending generally vertically between outer ends of corresponding trusses.

* * * * *